US005331687A

United States Patent [19]

Kronenberger

[11] Patent Number: 5,331,687

[45] Date of Patent: Jul. 26, 1994

[54] SIZE ADJUSTABLE HEADWEAR PIECE

[75] Inventor: Robert A. Kronenberger, Deerfield, Ill.

[73] Assignee: American Needle, Buffalo Grove, Ill.

[21] Appl. No.: 926,505

[22] Filed: Aug. 7, 1992

[51] Int. Cl.[5] ..... A42B 1/22

[52] U.S. Cl. ..... 2/195.2; 2/418

[58] Field of Search ..... 2/171.4, 171.7, 171.8, 2/197, 417, 418, 420; 24/68 B, 68 SK

[56] References Cited

U.S. PATENT DOCUMENTS

| | | | |
|---|---|---|---|
| 2,336,950 | 12/1943 | Moss | 2/197 |
| 2,925,606 | 2/1960 | DeGrazia | 2/197 |
| 4,433,456 | 2/1984 | Baggio | 24/685 K |
| 4,942,628 | 7/1990 | Freund | 2/420 |
| 4,993,079 | 2/1991 | Johnson | 2/418 |
| 5,031,246 | 7/1991 | Kronenberger | 2/197 |

*Primary Examiner*—Clifford D. Crowder
*Assistant Examiner*—Diana L. Biefeld
*Attorney, Agent, or Firm*—Wood, Phillips, VanSanten, Hoffman & Ertel

[57] ABSTRACT

A headwear piece having a crown defining an opening for reception of the head of a wearer, structure for varying the effective diameter of the crown opening to accommodate different size wearer heads, and an actuator for operating the crown opening varying structure. The actuator includes a switch which, in one form, is a dial that is rotatable about an axis to operate the crown opening varying structure to thereby effect the variation in the effective diameter of the opening in the crown. In another form, the switch is translatable to effect a variation in the diameter of the crown opening.

18 Claims, 2 Drawing Sheets

SIZE ADJUSTABLE HEADWEAR PIECE

BACKGROUND OF THE INVENTION

1. Field of the Invention

This invention relates to headwear, such as caps, hats and visors and, more particularly, to a headwear piece that can be configured to accommodate a plurality of different head sizes.

2. Background Art

To accommodate different wearer head sizes, purveyors of headwear have the option of either stocking a range of fitted headwear pieces or incorporating a size adjustment capability into the headwear. While fitted headwear has the advantage that it does not expose unsightly adjustment structure, it has the drawback that it will fit only one head size. Consequently, it is necessary to stock a full range of sizes. It is generally difficult to control inventory to meet the size demands.

Conventional size adjustment structures for headwear have taken a wide range of forms. Most commonly, in baseball-type caps, or other caps with a flexible crown, an inverted, U-shaped cutout is provided at the rear of the cap. The size adjustment structure is operable to selectively control the width of the "U" to thereby alter the effective diameter of the opening defined by the crown.

It is known, for example, to use an elastic band to control the crown opening diameter. An exemplary structure is shown in U.S. Pat. 4,131,953, to Kimotsuki.

One problem with an elastic band is that, with a pliable crown, the elastic tends to collapse the crown and distort the shape thereof. Further, with the elastic band, the crown embraces a smaller head a lesser holding force than it would a larger head.

It is known to use buckles to cooperate with a strap that surrounds a crown and is manipulated through the buckle to alter the effective diameter of a loop defined by the strap. An exemplary structure in shown in U.S. Pat. 4,864,662, to Frank. A buckle is undesirable from the standpoint that the buckle and associated strap must be fully exposed externally of the crown to allow the user to hold the buckle and push in or draw out the free end of the strap.

It is also known to use a two-part strap including selectively Joinable ends. One of the strap parts has a series of through holes with the other having studs which can be pressed through, and frictionally held within, the holes. Placing the studs in different holes effects size adjustment for the crown. Exemplary structures are shown in U.S. Pat. Nos. 4,192,017, to Fay, and U.S. Pat. 4,481,681, to Hankin. One problem associated with this type of structure is that the studs are prone to falling off in normal use and/or after repeated adjustments are made to the headwear piece.

A still further prior art structure is shown in U.S. Pat. 4,993,079, to Johnson. Johnson employs a sweatband that can be tied snugly around a user's head using a drawstring. The drawstring is tied in a position to cause the sweatband to closely fit the user's head. While Johnson discloses a sweatband that is preattached, the prior art structures commonly utilize such a drawstring within a retaining sleeve.

Generally, these structures require the user to take the headwear piece off, tie the drawstring ends, and replace the headwear piece. This becomes an inconvenient, trial and error exercise for the wearer. Additionally, the drawstring normally hangs down at the back of the hat and may be unsightly and/or an unwanted, obtrusive addition to the headwear.

Most prior art structures have the drawback that the user must take the headwear off to effect size variation. Repeated attempts might have to be made to achieve a desired fit. Frequently, a user will settle for less than the desired fit to avoid the inconvenience of the repetitive, and oft times inconvenient, adjustment steps.

This last problem is overcome by the structure shown in U.S. Pat. No. 5,031,246, to Kronenberger, assigned to the assignee of this invention.

SUMMARY OF THE INVENTION

The present invention is specifically directed to overcoming the above-enumerated problems in a novel and simple manner.

The present invention has, as one of its principal objectives, the provision of a headwear piece which is adjustable to accommodate a plurality of different wearer head sizes. It is a further objective of this invention to facilitate size adjustment, preferably with the headwear piece in place on a wearer's head.

More particularly, the present invention comprehends a headwear piece having a crown defining an opening for reception of the head of a wearer, structure for varying the effective diameter of the crown opening to accommodate different size wearer heads, and an actuator for operating the crown opening varying structure. The actuator includes a switch which, in one form, is a dial that is rotatable about an axis to operate the crown opening varying structure to thereby effect a variation in the effective diameter of the opening in the crown.

Preferably, the dial is located to be accessible externally of the crown. This allows the user to place the headwear piece on and then effect the requisite size adjustment.

In one form, the crown opening varying structure is an elongate flexible element on the crown that extends at least partially around the crown opening.

In one form, the flexible element extends between the actuator and a first location on the crown with the flexible element being connected to the crown at the first location. The actuator is operable to vary the length of the flexible element between the actuator and the first crown location.

In another form, a single flexible element has spaced ends which are each connected to the actuator and the actuator manipulates the flexible element to selectively vary the diameter of a loop defined cooperatively by the flexible element and actuator.

The flexible element could be a cord, a strap, or the like, and made of plastic, metal, or other suitable structure.

In one form, the actuator wraps and unwraps the flexible element.

In another form of the invention, the crown opening varying structure is defined by a portion of the crown that is movable between first and second positions. The movable portion of the crown is connected to the actuator to be repositionable selectively by the actuator between first and second positions. The crown opening has a first effective diameter with the movable crown portion in its first position and a second effective diameter with the crown portion in its second position.

In still another form, the actuator dial is constructed to be incrementally moved and releasably held in a plurality of different positions. This can be accomplished by a ratchet, or other suitable mechanism.

The invention further contemplates the combination of the above structure with an operating key that is insertable into and removable from the actuator. The key is operable to turn the dial with the key inserted. In one form, the dial is rotatable only with the key inserted.

In one form, the crown has an outer shell that cover the crown opening varying structure so that only the actuator is visible from externally of the headwear piece. The crown may extend continuously around the crown opening without there being any cutouts for size adjustment in the crown. This avoids any detraction from the appearance of the headwear piece. With this construction, the shell can collapse and expand in response to movement of the actuator and a change in the effective size of the crown opening.

The invention further contemplates a headwear piece having a crown, structure for varying the crown opening diameter, and an actuator. The actuator includes a switch. There is cooperating structure on the crown and switch for guiding movement of the switch between first and second positions. The crown has a first effective diameter with the switch in the first position. The switch causes the crown to assume a second effective diameter that is different than the first effective diameter as an incident of the switch being moved form its first position into its second position.

In one form, the switch is movable between its first and second positions in a translatory path.

Cooperating structure can be provided on the crown and switch for allowing the switch to be incrementally moved and releasably held in a plurality of different positions.

The invention still further comprehends a headwear piece having a crown, with structure for varying the effective diameter of the crown opening controlled by an actuator. The actuator has an element that is movable relative to the crown between first and second positions to thereby cause the diameter of the crown opening to be changed. The crown has a shell defining an external surface of the headwear piece, which shell is configured to fully cover the crown opening varying structure so that only the actuator itself is exposed to view externally of the headwear piece with the headwear piece in place on a wearer's head.

In one form, the headwear piece is a baseball-type cap.

DETAILED DESCRIPTION OF THE DRAWINGS

Figure 1:
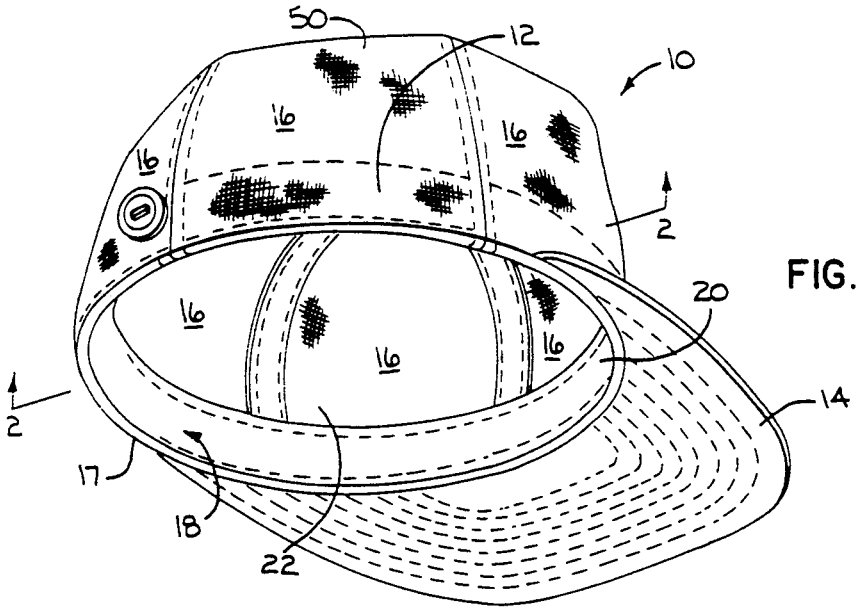
FIG. 1 is a bottom perspective view of a baseball-type cap having structure according to the present invention incorporated therein to controllably alter the diameter of an opening defined by the crown of the cap for reception of a wearer's head.

An exemplary headwear piece is shown at 10 that is suitable for incorporation of the present invention. The headwear piece 10 is a baseball-type cap, however it should be recognized that the invention is usable in virtually all different styles of headwear having a crown to embrace a wearer's head. For example, the invention could be incorporated into a visor which does not have a closed top.

The cap 10 consists of an inverted, cup-shaped crown 12 onto which a bill/visor 14 is affixed to project forwardly therefrom. The crown 12 is defined by six fabric gores 16 sewn together along adjacent abutting edges. The lower edge 17 of the crown 12 defines an opening 18 to accommodate the user's head.

A continuous, annular sweat band 20 is sewn onto the inside surface 22 of the crown 12 adjacent the lower crown edge 17. The sweat band 20 is made from a moisture absorbent material to absorb perspiration from the user and shield the fabric crown 12 from the user's head to prevent perspiration stains as might discolor or otherwise detract from the appearance of the cap 10. An optional plastic layer (not shown) is interposed between the sweat band 20 and crown 12 to prevent migration of moisture from the sweat band to the crown 12.

In a conventional baseball cap, the effective diameter of the crown 12 at the sweat band 20 determines the cap size. The diameter is characterized as the "effective" diameter because neither the crown opening 18 nor the human head is perfectly round.

Figure 14:
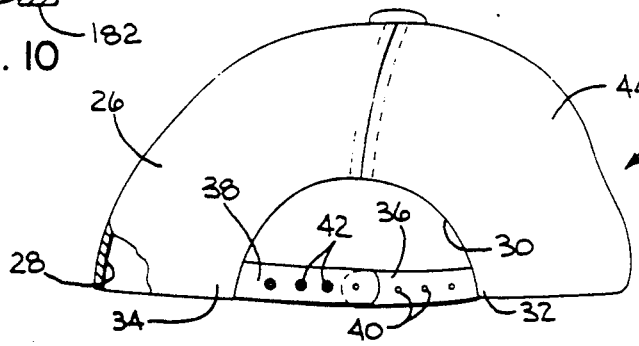
FIG. 14 PRIOR ART
FIG. 14 is a rear elevation view of a prior art mechanism for varying the effective diameter of the crown opening on a baseball-type cap.

The present invention is directed to a means for varying the effective diameter of the crown opening 18 on a cap. The advantages of the present invention can be appreciated by first viewing an exemplary prior art cap, shown at 24 in FIG. 14. The cap 24 has an inverted, cup-shaped crown 26 formed of a flexible material. The crown 26 defines an opening 28 for reception of the wearer's head in the same manner as the inventive cap 10. To permit variation of the effective diameter of the crown opening 28, an inverted, U-shaped cutout 30 is provided at the back of the crown 26. The cutout 30 defines spaced flaps 32, 34 connected to cooperating, flexible trap parts 36, 38, respectively. The strap part 36 has a plurality of longitudinally spaced studs 40 projecting rearwardly therefrom. The studs 40 can be pressed from front to rear through, and frictionally retained within, through openings 42 in the other strap part 38.

The combined length of the strap parts 36, 38 between the flaps 32, 34 is altered by changing which studs 40 are directed into which openings 42. By increasing the amount of overlap of the strap parts 36, 38, the flaps 32, 34 are drawn closer to each other to thereby diminish the width of the cutout 30 and reduce the effective diameter of the crown opening 28. The crown 26 has a flexible outer shell 44 that collapses to accommodate this reduction in the diameter of the opening 28.

There are several drawbacks associated with the cap 24, a number of which are noted above. Most notably, the cutout 30 detracts from the appearance of the cap 24. Further, the studs 40 are prone to breaking off, which could render the entire cap 24 unusable. Still further, the user may be required to repeatedly take the cap off and effect adjustment to arrive at the best size. The present invention obviates these problems as well as other problems encountered with prior art headwear pieces.

Figure 2:
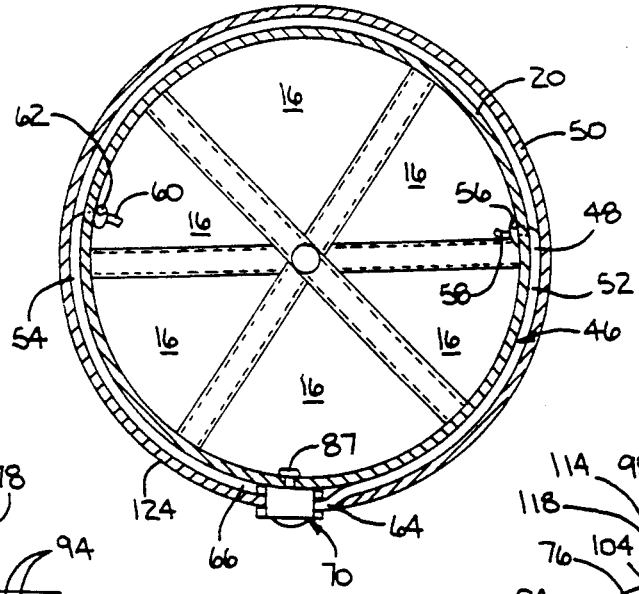
FIG. 2 is a section view of the cap taken along line 2—2 of FIG. 1.
Figure 4:
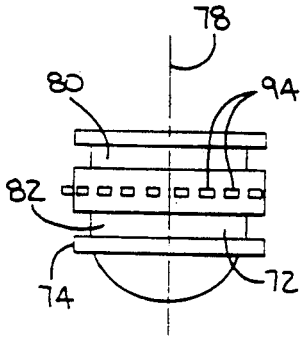
FIG. 4 is an isolated plan view of a switch on the actuator of FIG. 3.

In one form of the invention, as shown in FIGS. 1-6, means are provided at 46 for varying the effective diameter of the crown opening 18 to accommodate different size wearer heads. In this embodiment, the means 46 includes a flexible element, in the form of a cord 48. The cord 48 resides between the sweat band 20 and a flexible outer shell 50 defined by the fabric gores 16. In FIG. 2, the cord 48 consists of separate lengths 52, 54. One cord length 52 is directed through the sweat band 20 into the opening 18 and has a knot 56 formed at its free end 58 to prevent the cord length 52 from being pulled out of the sweat band 20. The other cord length 54 has a free end 60 projecting through the sweat band 20 into the opening 18 and is tied to define a knot 62.

The opposite free ends 64, 66 of the cord lengths 52, 54, respectively, are operatively connected to an actuator means 70 for the cord 48. The actuator means 70 has a switch 72, in the form of a rotary dial. The dial 72 has a cylindrical body 74 that is mounted within a cylindrical sleeve 76 for guided movement in rotation about an axis 78.

The body 74 has two annular, axially spaced, undercut surfaces 80, 82 each having a width slightly larger than the diameter of the cord lengths 52, 54. The cord free end 66 is embedded in a bore 84 in the body 74 in axial alignment with the surface 80. The free end 64 of the cord part 52 is embedded in a similar bore 86 that is diametrically opposite to the bore 84 and in axial alignment with the undercut surface 82. The body 74 is held in place by a mounting bolt 86 extending through the sweat band 20 from the opening 18 into the body 74.

Figure 5:
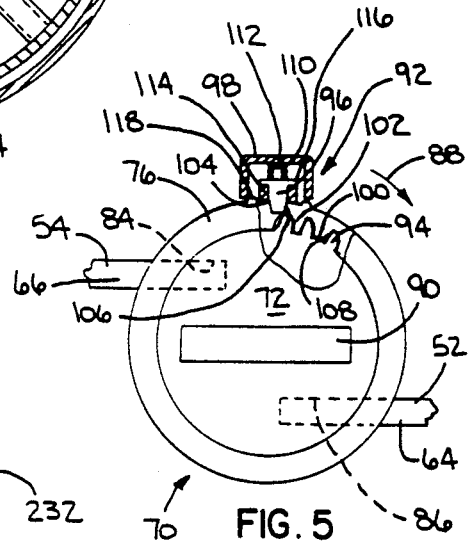
FIG. 5 is a rear elevation view of the actuator partially broken away to reveal a ratchet mechanism to allow incremental movement of and releasable holding of the switch in a plurality of different positions.

With the above arrangement, rotation of the dial 72 in a clockwise direction in FIG. 5, as indicated by arrow 88, causes the cord lengths 54, 52 to be wrapped around the body 74. This results in the effective length of the cord 48 being shortened, which collapses the sweat band 20 radially inwardly into the opening 18 to thereby reduce the effective diameter of the opening 18.

To facilitate rotation of the dial 72, an enlarged knob 90 is provided thereon to be readily grasped between two finger by a wearer.

To facilitate adjustment of the size of the opening 18, a ratchet means is provided at 92. The ratchet means 92 consists of a plurality of circumferentially spaced teeth 94 projecting radially outwardly from the body 74. The teeth 94 cooperate with a biased pin 96 on a slide button 98. The pin 96 is configured to move into the space 100 between adjacent teeth 94 to thereby arrest rotation of the dial 72. The teeth 94 have curved cam edges 102 to encounter a ramped surface 104, defined by a taper on the pin 96, to thereby urge the pin 102 repetitively upwardly and downwardly over the teeth 94 as the dial 72 is rotated in the direction of arrow 88. The pin 96 has a blocking edge 106 to engage a stop edge 108 on the trailing edge of the teeth 94 with the pin 96 located in a blocking position between adjacent teeth 94, to thereby prevent rotation of the dial 72 opposite to the direction of the arrow 88.

The pin 96 is normally biased radially towards the dial axis 78 by a coil spring surrounding a post 112 carried by the slide button 98. A cylindrical guide sleeve 114 abuts an enlarged head 116 on the pin 96 to arrest radially inward movement of the pin 96 to prevent jamming and situate the pin 96 for proper cooperation with the ratchet teeth 94.

Figure 3:
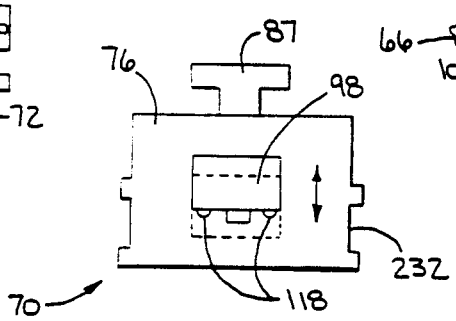
FIG. 3 is an enlarged plan view of an actuator for effecting variation of the effective diameter of the crown opening.

The slide button 98 is movable between a ratchet "off" position, shown in solid lines in FIG. 3, and a ratchet "on" position, shown in phantom lines in FIG. 3. Detent mechanisms 118, each in the form of a dimple and socket, maintain the slide button 98 in each of the "on" and "off" positions therefor. With the slide button 98 in the "on" position, the pin 96 is situated in the path of the ratchet teeth 94 so that the ratchet means 92 is operable. By shifting the button 98 to the solid line position in FIG. 3, the ratchet means 92 is disabled by reason of the pin 96 being moved out of the path of the ratchet teeth 94. The dial 72 can then rotate freely in either direction.

Figure 6:
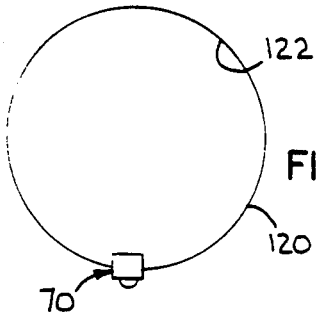
FIG. 6 is a schematic plan view of the actuator of FIG. 3 operably connected to opposite ends of a flexible element to define a constrictable loop.

A slightly modified form of the inventive structure in FIGS. 1-5 is shown in FIG. 6. Instead of using separate cord lengths, a single cord 120 extends around the sweat band 20 and is connected to the actuator means 70 to define a closed loop 122.

Figure 7:
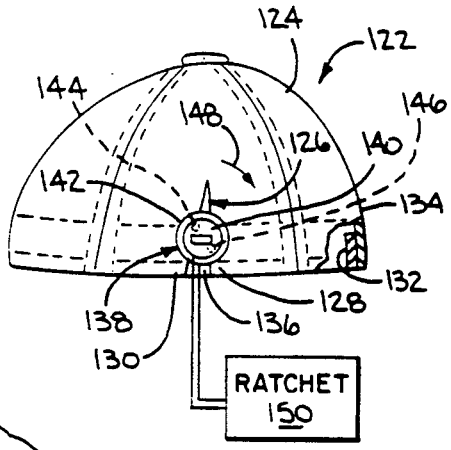
FIG. 7 is a rear elevation view of a baseball-type cap with a modified form of structure for varying the effective diameter of a crown opening according to the present invention.

Another modified form of the invention is shown in FIG. 7 on a cap 122. The cap 122 has a flexible shell 124 having a pleat 126 at the back end thereof. The pleat 126 defines flexible flaps 128, 130 that can be drawn towards each other to reduce the diameter of the head opening 132 defined by the crown 134. A portion 136 of the shell 124 is tucked under the flaps 128, 130 to allow the relative repositioning of the flaps 128, 130. The flaps 128, 130 define a means for varying the effective diameter of the crown opening 132.

An actuator 138 is provided at the rear of the cap 122 and consists of a dial 140 mounted rotatably within a cylindrical guide sleeve 142. The dial 140 has a post 144 attached to the flap 130 and a diametrically opposite post 146 attached to the flap 128. By rotating the dial 140 in a clockwise direction, as indicated by arrow 148, the post 144 draws the flap 130 towards the flap 128 simultaneously as the post 146 draws the flap 128 towards the flap 130 so that the diameter of the opening 132 is diminished. A ratchet means, shown schematically at 150, can be provided to allow incremental movement and holding of the dial 140 in a plurality of different positions.

Figure 8:
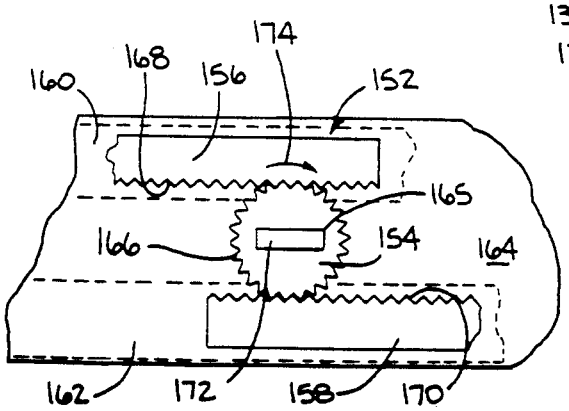
FIG. 8 is a fragmentary, rear elevation view of a further modified form of structure for varying the effective diameter of a crown opening according to the present invention.

In FIG. 8, a further modified form of means for varying the effective diameter of a crown opening is shown at 152 to be operable by a dial 154. The combined mechanism, including the means 152 and actuator 154, is operable in similar fashion to the mechanism described with respect to FIGS. 1–6. Instead of individual cords following movement of the actuator 154, flexible straps 156, 158 are provided within sleeves 160, 162 on a sweat band 164. The actuator 154 consists of a dial 165 having a toothed outer peripheral edge that is simultaneously in mesh with rows of teeth 168, 170 on the strips 156, 158, respectively. Rotation of the dial, 164 through a finger engaging knob 172 in a clockwise direction, as indicated by arrow 174, causes the strip 156 to be advanced from left to right in FIG. 8 and the strip 158 to be advanced simultaneously from right to left. The ends of the strips 156, 158 remote from the actuator 154 can be connected to the sweat band 165 so that the straps 156, 158 diminish the size of the head opening in the same manner that the aforementioned cord lengths 52, 54 do.

A still further modified form of the present invention is shown in FIGS. 9–12. An actuator 176 is translatable from a first solid line position in FIG. 9, to a second intermediate position, shown in phantom lines, relative to a guide element 178 on the crown 179. The guide element 178 has spaced, U-shaped flanges 180, 182 opening towards each other to define a guide slot 184 for the actuator 176. The actuator 176 has offset guide legs 186, 188 that move within the slot 184 as adjustment is carried out through the actuator 176.

Figure 9:
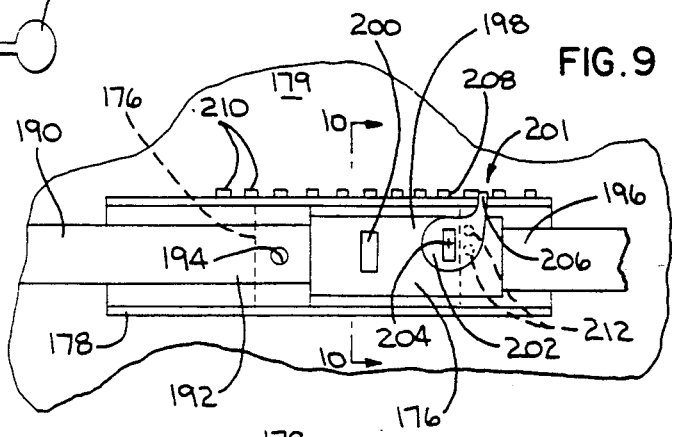
FIG. 9 is a fragmentary, rear elevation view of a further modified form of structure for varying the effective diameter of a crown opening according to the present invention.
Figure 10:
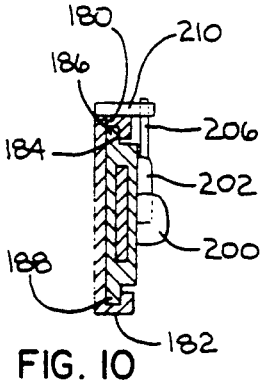
FIG. 10 is a section view of the inventive structure for varying the effective diameter of a crown opening taken along line 10—10 of FIG. 9.
Figure 11:
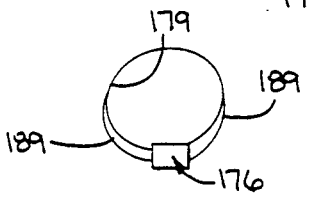
FIG. 11 is a schematic plan view of a crown with the actuator of FIG. 9 incorporated therein.
Figure 12:
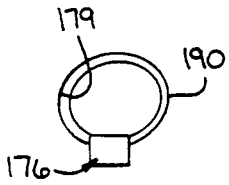
FIG. 12 is a view as in FIG. 11 with a modified form of structure to cooperate with the actuator of FIG. 9.

The means for varying the effective diameter of the opening defined by the crown 180 is a single part strap 190, as shown in FIGS. 9, 10 and 12, or a multi-part strap 189, as shown in FIG. 11. One end 192 of the strap 190 is secured to the crown by a rivet 194. The opposite strap end 196 is connected to a slider block 198 that is part of the actuator 176.

An enlarged finger grip 200 is provided on the slider block 198 to facilitate its movement. Movement of the slider block 198 from right to left in FIG. 9 results in the effective diameter of the strap 190 being diminished to thereby reduce the head opening size for the crown 180.

A ratchet means is provided at 201. The ratchet means 201 includes a knob 202 pivotably connected to the slide block 198 for rotation about a fore and aft axis 204. The knob 202 has a bendable leg 206 that can be directed into the space 208 defined between adjacent teeth 210 projecting rearwardly from, and spaced equidietantly along, the flange 180. The leg 206 has sufficient resilience that it can flex to move out from between adjacent teeth and back into a next adjacent set of teeth as the slider block 298 is moved. Spaced detent means 212 releasably maintain the knob 202 in each of the position shown in FIG. 9 and a different position in which the knob 202 is rotated to draw the leg 206 out of alignment with the teeth 210 and thereby disable the ratchet means 201.

Figure 13:
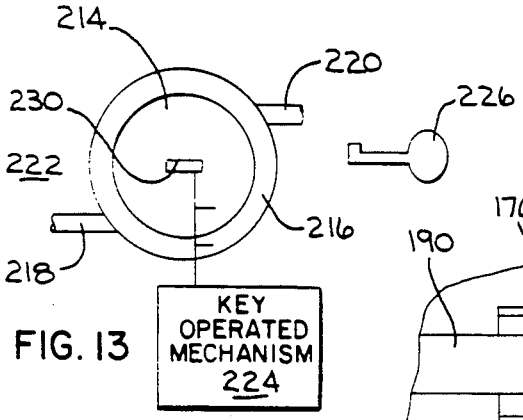
FIG. 13 is an end elevation view of a further modified form of structure for varying the effective diameter of a crown opening according to the present invention to be operable by a separate key.

A still further modified structure, according to the present invention, is shown in FIG. 13. In FIG. 13, a rotary actuator 214 is mounted for rotation within a cylindrical sleeve 216 and connected to two cord ends 218, 220 to wind the cord ends 218, 220 about the actuator 214 to thereby reduce the effective diameter of an opening defined by a crown 222.

In FIG. 13, a mechanism, shown schematically at 224. acts between the actuator 214 and sleeve 216 to permit rotation of the actuator 214 relative to the sleeve 216 through a key 226. Preferably, the mechanism 224 is such that the actuator 214 can be rotated only with the key 226 inserted within a key slot 230 in the actuator 214.

With the inventive structure, it can be seen that the user can place the headwear piece 10 in place and then effect the desired size adjustment to effect a comfortable fit. At the same time, the outer shell 50 of the crown 12 on the headwear piece 10 can be made free of cutouts and can be fit with the actuator means 70 so that only the actuator dial and rear portion of the guide sleeve 76 are exposed externally of the cap 10. To facilitate this, the body 74 has an annular undercut 232 approximately equal to the thickness of the shell 124 so that the shell 124 will nest neatly in the undercut 232.

The foregoing disclosure of specific embodiments is intended to be illustrative of the broad concepts comprehended by the invention.

I claim:

1. A headwear piece comprising:

a crown having an inside and an outside and defining an opening for reception of the head of a wearer, there being a sweatband on the crown to abut to a wearer's head;

means on the crown for varying the effective diameter of the crown opening to accommodate different size wearer heads, said crown opening varying means residing at least partially outside of the sweatband; and actuator means for operating the crown opening varying means, said actuator means including an actuator switch comprising a dial that is rotatable about an axis to operate the crown opening varying means and reconfigure the sweatband to thereby effect a variation in the effective diameter of the crown opening.

2. The headwear piece according to claim 1 wherein the drown opening varying means comprises an elongate flexible element that extends at least partially around the crown opening.

3. The headwear piece according to claim 2 wherein the elongate flexible elements extends between the actuator means and a first location on the crown, there are means for connecting the flexible element to the crown at said first location and the actuator means comprises means for manipulating the flexible element to selectively vary the length of the flexible element between the actuator means and said first crown location.

4. The headwear piece according to claim 2 wherein said flexible element comprises a cord.

5. The headwear piece according to claim 2 wherein said flexible element comprises a strap.

6. The headwear piece according to claim 2 wherein the actuator means comprises means for selectively wrapping and unwrapping the flexible element.

7. The headwear piece according to claim 1 wherein the actuator means includes means for allowing the dial to be incrementially moved and releasably held in a plurality of different positions.

8. The headwear piece according to claim 7 wherein the allowing means comprises ratchet means.

9. The headwear piece according to claim 1 wherein the headwear piece is a baseball-style cap, said crown has a collapsible shell that defines the external surface of the crown and extends continuously around the crown opening without there being any cutouts for size adjustment in the external surface of the crown.

10. The headwear piece according to claim 1 wherein the crown has an outer shell that defines the external surface of the crown and the actuator switch has at least a portion that extends through the crown to be exposed at the external surface of the crown for manipulation thereof.

11. A headwear piece comprising:

a crown defining an opening for reception of the head of a wearer;

means on the crown for varying the effective diameter of the crown opening to accommodate different size wearer heads; and actuator means for operating the crown opening varying means, said actuator means including an actuator switch comprising a dial that is rotatable about an axis to operate the crown opening varying means and thereby effect a variation in the effective diameter of the crown opening, wherein the crown opening varying means comprises an elongate flexible element on the crown that extends at least partially around the crown opening, wherein the crown includes an outer shell and the outer shell covers the crown opening varying means so that only the actuator means is visible from externally of said headwear piece.

12. A headwear piece comprising:

a crown defining an opening for reception of the head of a wearer, there being a sweatband on the crown to abut to a wearer's head;

means on the crown for varying the effective diameter of the crown opening to accommodate different size wearer heads, said crown opening varying means varying the effective diameter of the crown opening by reconfiguring at least one of the sweatband and the crown; and actuator means for operating the crown opening varying means, said actuator means including an actuator switch, there being cooperating means on the switch and at least one of the sweatband and crown for guiding movement of the switch between first and second postions, said crown opening having a first effective diameter with the switch in its first position, said switch causing the crown opening to have a second effective diameter that is different that the first effective diameter as an incident of the switch being moved from its first position into its second position and causing the crown opening to having said first effective diameter as an incident of the switch being moved from its second position into its first positon.

13. The headwear piece according to claim 12 wherein the crown opening varying means comprises an elongate flexible element on the crown that extends at least partially around the crown opening.

14. The headwear piece according to claim 13 wherein said flexible element comprises a strap.

15. The headwear piece according to claim 13 wherein the cooperating means on the crown and switch includes means for allowing the switch to be incrementally moved and releasably held in a plurality of different positions.

16. A headwear piece comprising:

a crown defining an opening for reception of the head of a wearer, there being a sweatband on the crown to abut to a wearer's head;

means on the crown for varying the effective diameter of the crown opening to accommodate different size wearer heads, said crown opening varying means varying the effective diameter of the crown opening by reconfiguring at least one of the sweatband and the crown; and actuator means for operating the crown opening varying means, said actuator means including an actuator switch, there being cooperating means on the crown and switch for guiding movement of the switch between first and second postions, said crown opening having a first effective diameter with the switch in its first position.

said switch causing the crown opening to have a second effective diameter that is different than the first effective diameter as an incident of the switch being moved from its first position into its second position, wherein the crown opening varying means comprises an elongate flexible element on the crown that extends at least partially around the crown opening, wherein the elongate flexible element extends between the actuator means and a first location on the crown and there are means for connecting the flexible element to the crown at said first location, said actuator means comprising means for manipulating the flexible element to selectively vary the length of the flexible element between the actuator means and said first crown location.

17. A headwear piece comprising:

a crown defining an opening for reception of the head of a wearer, there being a sweatband on the crown to abut to a wearer's head;

means on the crown for varying the effective diameter of the crown opening to accommodate different size wearer heads, said crown opening varying means varying the effective diameter of the crown opening by reconfiguring at least one of the sweatband and the crown; and actuator means for operating the crown opening varying means, said actuator means including an actuator switch, there being cooperating means on the crown and switch for guiding movement of the switch between first and second positions, said crown opening having a first effective diameter with the switch in its first position.

said switch causing the crown opening to have a second effective diameter that is different than the first effective diameter as an incident of the switch being moved from its first position into its second position, wherein the crown opening varying means comprises an elongate flexible element on the crown that extends at least partially around the crown opening, wherein the cooperating means on the crown and switch includes means for allowing the switch to be incrementally moved and releasably held in a plurality of different positions.

wherein the cooperating means comprises ratchet means.

18. A headwear piece comprising:

a crown defining an opening for reception of the head of a wearer, said crown having at least a portion thereof that is collapsible;

means on the crown for varying the effective diameter of the crown opening to accommodate different size wearer head, said crown opening varying means being connected to the crown so that it effects collapse of the crown portion as the crown opening varying means reduces the effective diameter of the crown opening; and actuator means for operating the crown opening varying means, said actuator means including an actuator switch comprising a dial that is rotatable about an axis to operate the crown opening varying means and therby effect a variation in the effective diameter of the crown opening.

* * * * *

UNITED STATES PATENT AND TRADEMARK OFFICE

CERTIFICATE OF CORRECTION

PATENT NO. : 5,331,687

DATED : July 26, 1994

INVENTOR(S) : Robert A. Kronenberger

It is certified that error appears in the above-identified patent and that said Letters Patent is hereby corrected as shown below:

Col. 1, line 46 change "Joinable"to --joinable--.

Col. 5, line 6 change "trap" to --strap--.

Col. 8, line 38 change "drown" to --crown--.

Col. 9, line 45 change "postions" to --positions--.

Col. 9, line 52 change "having" to --have--.

Col. 9, line 55 change "positon" to --position--.

Col. 10, line 17 change "postions" to --positions--.

Col. 11, line 2 change the period to a comma.

Col. 11, line 11 change "head" to --heads--.

Signed and Sealed this

Fifteenth Day of November, 1994

Bruce Lehman

*Attest:*

BRUCE LEHMAN

*Attesting Officer*

*Commissioner of Patents and Trademarks*